United States Patent [19]

Cain

[11] 4,445,628

[45] May 1, 1984

[54] APPARATUS FOR SENSING EMPTY HOPPERS

[75] Inventor: George R. Cain, Pittsburgh, Pa.

[73] Assignee: Koppers Company, Inc., Pittsburgh, Pa.

[21] Appl. No.: 334,128

[22] Filed: Dec. 24, 1981

[51] Int. Cl.[3] ..... F27D 3/00

[52] U.S. Cl. ..... 222/66; 414/161; 110/101 CB; 110/101 CD; 110/108

[58] Field of Search ..... 222/23, 52, 53, 64–66, 222/1; 414/161, 163; 110/101 C, 101 CF, 101 CB, 101 CC, 101 CD, 108, 293; 340/610

[56] References Cited

U.S. PATENT DOCUMENTS

| | | | |
|---|---|---|---|
| 3,368,948 | 2/1968 | Meunier . | |
| 3,542,218 | 11/1970 | Herbst | 414/163 |
| 3,554,682 | 1/1971 | Krausse . | |
| 3,583,437 | 6/1971 | Mastroianni | 222/64 X |
| 3,628,676 | 12/1971 | Tucker . | |
| 3,632,019 | 1/1972 | Harm | 222/64 X |
| 3,682,339 | 8/1972 | Knappstein . | |
| 3,698,574 | 10/1972 | Louks | 222/66 X |
| 3,734,313 | 5/1973 | Gauthier | 222/64 X |
| 3,834,806 | 9/1974 | Whited | 222/66 X |
| 3,847,303 | 11/1974 | Szendroi | 222/66 |
| 3,992,598 | 11/1976 | Welsh | 340/610 X |
| 4,013,321 | 3/1977 | Pendleton . | |
| 4,036,408 | 7/1977 | Dugge | 222/193 |
| 4,189,272 | 2/1980 | Gregor | 414/161 |
| 4,201,315 | 5/1980 | Chuss | 222/66 |

FOREIGN PATENT DOCUMENTS 971533 9/1964 United Kingdom .

*Primary Examiner*—Joseph J. Rolla
*Assistant Examiner*—Kevin P. Shaver
*Attorney, Agent, or Firm*—Daniel J. Long; Herbert J. Zeh, Jr.

[57] ABSTRACT

A gravity operated conical hopper having a sliding closure plate which is pneumatically activated as soon as the hopper has been emptied. An apparatus and method is also disclosed for pneumatically detecting and automatically closing the hopper to stop the flow of contained material after material has been discharged to a particular level.

9 Claims, 4 Drawing Figures

APPARATUS FOR SENSING EMPTY HOPPERS

BACKGROUND OF THE INVENTION

1. Field of the Invention

The present invention deals with hoppers and bins for the containment of granular material and, in particular, with coal containing hoppers which are mounted on larry cars for the purpose of charging coke ovens.

2. Description of the Prior Art

Coke ovens are conventionally provided with coal by means of larry cars which traverse the battery top on tracks and which transport a plurality of coal containing hoppers. These hoppers generally are open at their tops and have converging sides and a bottom discharge opening which may be closed by means of a sliding gate. The hoppers are also usually gravity operated so that when the larry car is positioned so that each of its hoppers is above a charging hole, the contents of these hoppers may be discharged by withdrawing their sliding gates from the bottom of their discharge openings. After a hopper has been emptied, however, it is important that its sliding gate be quickly closed so as to prevent the entry of coke oven gases through the discharge opening into the hopper interior. If substantial amounts of these gases do enter the interior of a hopper, they may condense on the hopper's interior walls so as to form tarry deposits which may impede the flow of coal from the hopper. It is also important that the sliding gate be closed in a timely manner to eliminate the possibility of discharging undue amounts of pollutants into the atmosphere and to prevent heat and flame damage to the hopper and other auxilliary equipment.

It has been the practice to rely on the larry car operator to make a determination as to when coal flow from a hopper had ceased and when to activate the sliding gate. Because, though, it is often difficult for an operator to determine when a hopper is actually empty, this method has not proven to be entirely satisfactory. Accordingly, various devices which make use of capacitance probes, paddle switches or pivoting plates which directly contact the coal have been suggested for the purpose of generating a signal to close the sliding gate at the precise moment that all of the coal has been fed from the hopper to the oven. Since, however, various disadvantages have been found to attend the use of some of these devices, it is the object of the present invention to provide a consistently reliable means of sensing the level of granular material in a hopper and, in particular, to detect when a hopper on a coke oven battery larry car is empty.

SUMMARY OF THE INVENTION

The present invention consists of a gravity operated, generally conical hopper for granular material in which an air conveying duct projects outwardly from the sidewall of the hopper near its lower discharge opening. This duct is connected to a blower or some other air current generating means at its terminal end and an air discharge duct depends from this air conveying duct. A pivoting vane or some other means of detecting changes in air pressure is mounted inside the air exhausting duct. This vane operates a switch which is connected with a means for operating a gate that closes the discharging hole so that this hole will be covered as soon as the hopper is emptied. In one embodiment of this invention the closure gate is also activated as soon as material is discharged from the hopper to a particular intermediate level.

BRIEF DESCRIPTION OF THE DRAWINGS

The present invention is further described in the accompanying drawings in which.

DETAILED DESCRIPTION

Figure 1:
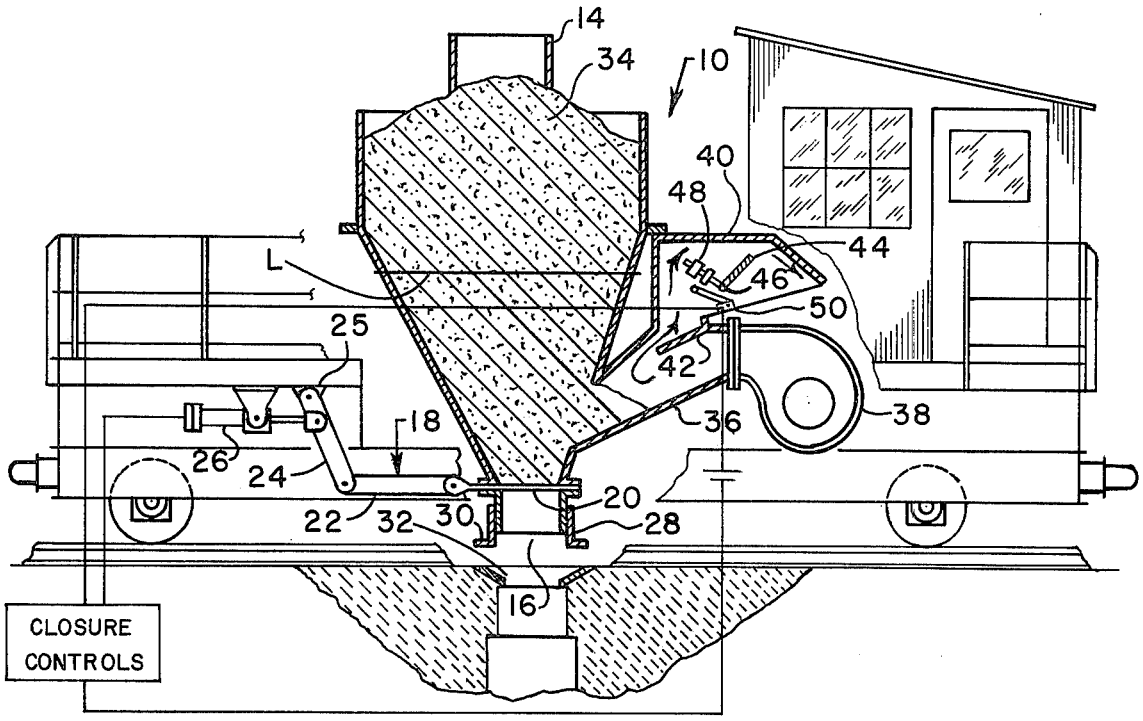
FIG. 1 is a front elevational view, partially in vertical section, of a coke oven larry car hopper embodying the present invention where parts of the larry car frame are not shown and where the hopper is filled with coal.
Figure 2:
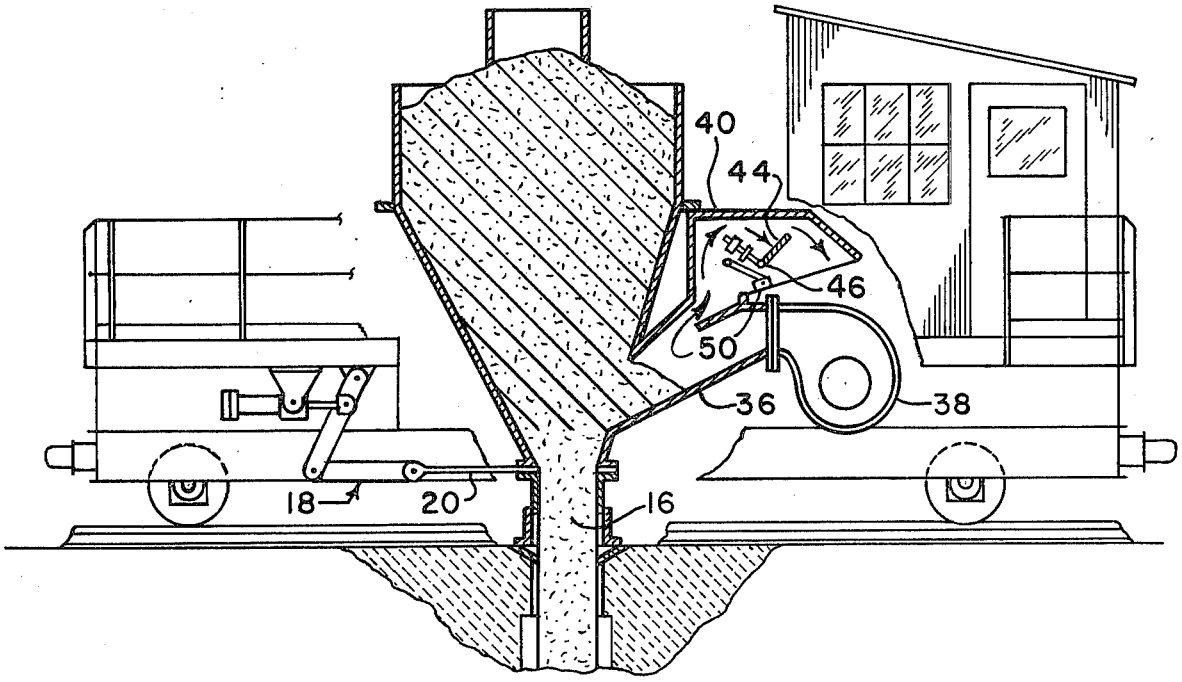
FIG. 2 is a view of a hopper embodying the present discharge similar to FIG. 1 except that the discharge of coal from the hopper has begun.
Figure 3:
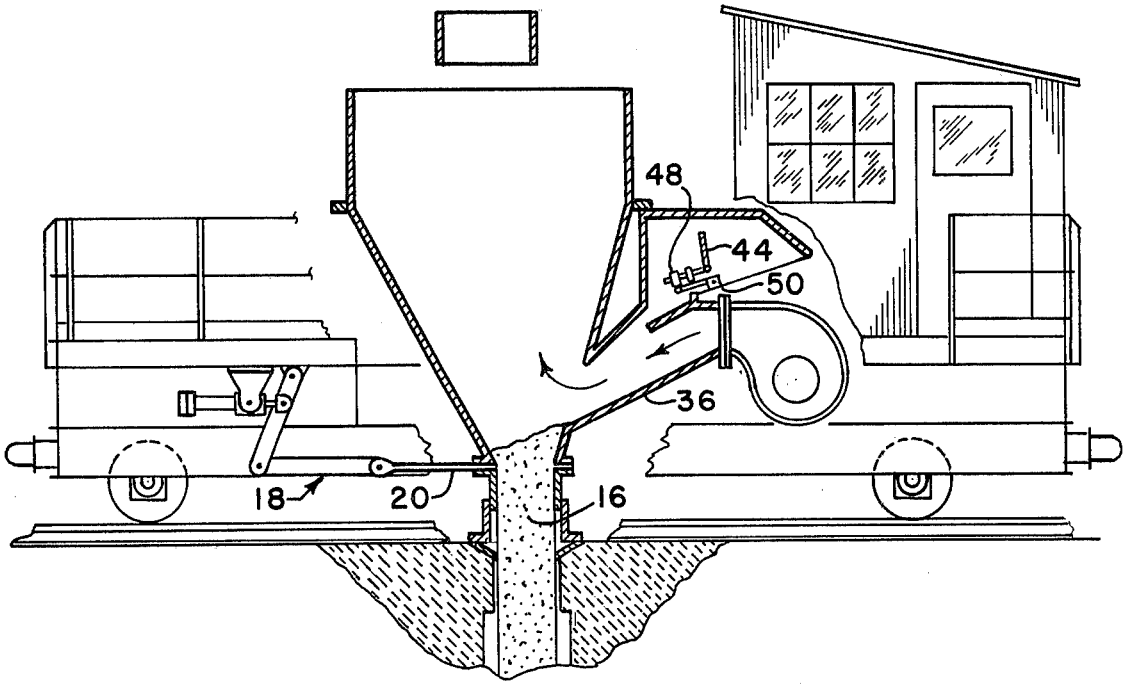
FIG. 3 is a view of a hopper embodying the present invention which is similar to FIG. 2 except that the discharge of coal from the hopper has progressed further.
Figure 4:
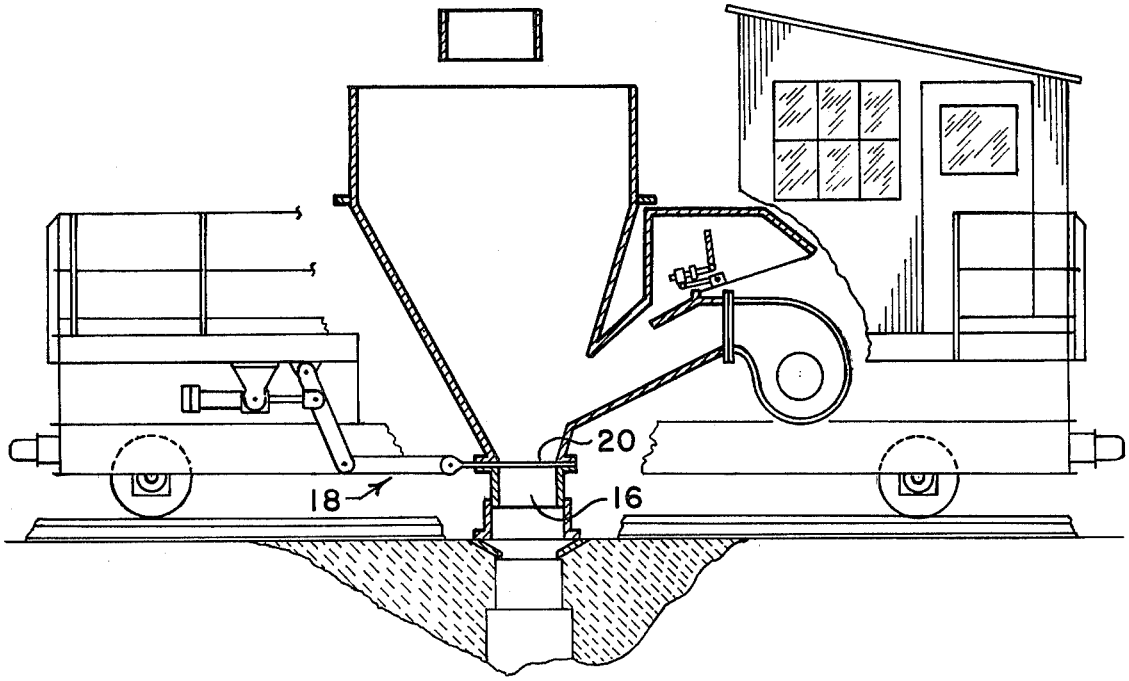
FIG. 4 is a view of a hopper embodying the present invention which is similar to FIG. 3 except that the discharge of coal from the hopper has been completed.

Referring to FIG. 1, a gravity operated coke oven larry car hopper is shown generally at numeral 10. The hopper has downwardly converging side walls 12 and is positioned below a charging ring 14. The side walls converge downwardly to the bottom discharging opening 16, which may be selectively opened or closed by a closure means shown generally at numeral 18. This closure means is made up of a plate like sliding gate 20, linkage arms 22 and 24 a fixed pivoting point structure 25, and a hydraulic piston and cylinder combination 26. Control means are provided to deactivate the closure means 18 so that the sliding gate 20 is withdrawn from the discharge opening. Control means are also provided to activate the closure means 18 so that the sliding gate may be replaced over the discharge opening. In the embodiment of this invention illustrated in the drawings, the piston and cylinder combination 26 is extended by means well known in the art to position the sliding gate over the bottom discharge opening 16, as is shown in FIGS. 1 and 4. The piston and cylinder combination 26 is also compressed by well known means to withdraw the sliding gate 20 from the discharge opening 16, as is shown in FIGS. 2 and 3. It will be observed from FIG. 1 that when the sliding gate 20 is positioned below the discharge opening 16, the coal 34 will be retained in the hopper. The sidewalls of the hopper have a downward extension 28 and a moveable drop, sleeve 30 is telescoped on said extension. As is shown in FIG. 2 when the sliding gate 20 is withdrawn, coal will flow by gravity into the charging hole 32.

It should be understood that the above described features are well known and conventional and do not in themselves describe the invention herein. Other equivalent arrangements to accomplish the above described functions are also possible.

Referring again to FIG. 1, there is shown an air duct 36 which depends from the sidewall 12 of the hopper in the vicinity of the bottom discharge opening 16. At the point where this duct joins the hopper, its sidewalls are open so as to allow fluid communication between the interior of the hopper and the duct when the hopper is empty of coal. Such fluid communication is illustrated in FIGS. 3 and 4. As is illustrated in FIGS. 1 and 2, there will be no fluid communication between the air duct 36 and the interior of the hopper when the level of coal in the hopper is above the point where the duct depends from the hopper. FIG. 1 also shows that a blower 38 is attached to the end of the air duct 36 on the opposite end of the duct from where it connects with the hopper. Between the blower and the hopper an air exhaust duct 40 extends upwardly from the lateral air duct 36 to allow fluid communication between the interior of the lateral air duct 36 and ambient air so that when the level of coal in the hopper is above the point where the lateral air duct joins the hopper sidewall the air current generated by the blower 38 will flow primarily first into the lateral air duct 36 then into the exhaust duct 40 as is shown by the arrows in FIG. 1. A fixed vane 42 which depends from the interior surface of the lateral air duct helps to channelize this air current so that it will be directed toward a pivoting vane 44 which is mounted inside the exhaust duct 40 on a bearing 46. Also mounted on this bearing 46 in a fixed angular relationship to pivoting vane 44 is a counterweight 48. Fixed to the inner wall of the exhaust duct 40 adjacent the pivoting vane and the counterweight is an electrical switch 50 which is connected in electrical circuit with a solenoid (not shown) which controls a valve (not show) which rearwardly pressurizes the hydraulic piston and cylinder combination 26. When the switch 50 is closed by moving it from its upper open position shown in FIGS. 1 and 2 to its lower closed position shown in FIGS. 3 and 4, the solenoid will be energized to adjust the valve so that the piston and cylinder combination will be rearwardly pressurized and thus expanded. The closing of the switch 50, as described above, will thus have the effect of automatically causing the closure means 18 and, in particular, the sliding gate 20 to cover the bottom discharging opening.

It will be understood that manual controls are also provided to expand and compress the piston and cylinder combination 26 so as to activate and deactivate, respectively, the closure means 18. Thus, as is shown in FIG. 2, after the filled hopper has been positioned over the charging hole the operator deactivates the closure means so as to remove the sliding gate 20 from the discharge opening 16 and thereby allows coal to flow into the charging hole. Still referring to FIG. 2, it will be seen that as long as the level of coal in the hopper is above the point where the air duct 36 joins the sidewall of the hopper the primary path for the air current generated by the blower 38 will be first through the air duct 36 and then out the exhaust duct 40. The resulting air pressure on the pivoting vane 44 will cause that vane to be pivoted on bearing 46 to its forward position shown in FIGS. 1 and 2. When the pivoting vane 44 is so positioned the counterweight 48 will also be pivoted to its upper position shown in FIGS. 1 and 2. It will also be observed that when the counterweight is in this position, it will be clear of switch 50 so that the switch will be in its upper, open position.

FIG. 3 illustrates the hopper of the present invention just before the hopper is emptied of coal. It will be seen from this figure that as coal is removed from the hopper side of the lateral air duct the air current generated by the blower will flow primarily first through the air duct 36 and then into the interior of the hopper. Thus, a negative pressure will be produced on the rearward side of the pivoting vane 44. This pressure, along with the effect of gravity on counterweight 48, will cause the pivoting vane 44 to assume its rearward position shown in FIGS. 3 and 4, and the counterweight 48 will correspondingly assume its lower position shown in those figures. This movement of the counterweight 48 will trip the switch 50 to its lower, open position which, as is described above, will have the effect of automatically activating the closure means 18 and reinserting the sliding plate 20 over the discharge opening 16, thus preventing the escape of coke oven gases into the interior of the empty bin.

It will, thus, be seen that there has been described, an apparatus for sensing when a hopper and, in particular, a gravity operated conically-shaped hopper with a bottom discharge opening has been emptied of its contents. While the above description has been made in terms of a coal hopper, it will be apparent to those skilled in the art that the apparatus of the present invention may be adapted for use with any type of granular material. It will also be noted that the present invention is not restricted to merely sensing when a hopper has been emptied and that the apparatus of the present invention may be readily adapted for the purpose of indicating when the level of material in such a hopper has reached a particular level in the hopper. Referring, for example, to FIG. 1, the apparatus described above might be modified to indicate that a particular level of coal L had been reached by joining the lateral air duct 36 to the sidewall at that level rather than adjacent the bottom of the hopper. Additionally, it will be appreciated that it may, for certain purposes, be desireable to merely generate a signal that a hopper has been emptied of granular material rather than actually automatically activating the closure means when the hopper is emptied. After such a signal has been generated, the hopper operator would usually proceed to manually activate the closure means. It will, thus, be understood that such an apparatus in which a signal is generated that a hopper is emptied, but that which is not automatically closed by that signal is, nevertheless, within the scope of the present. Finally, it will also be appreciated that there has been described, herein, a method for sensing when a hopper has been completed emptied or emptied to a desired level. In particular, it will be noted that this method involves establishing a constant velocity air current directed from the means for generating an air current through the air conveying duct and out the exhaust duct while the interior air pressure in the exhaust duct is continuously monitored. The closure means are then deactivated to begin discharge of granular material, and when air pressure in the exhaust duct changes a signal is generated which either automatically activates the closure means or alerts an operator to manually activate the closure means. The practice of the above described method is also considered to fall within the scope of the present invention. Although the invention has been described with a certain degree of particularity, it is to be understood that the present disclosure has been made only as an example and that the scope of the invention is defined by what is hereafter claimed.

What is claimed is:

1. In a gravity operated hopper for granular material having a top charging opening, sidewalls converging downwardly to form a bottom discharging opening, closure means for said bottom discharging opening, control means for deactivating said closure means to allow discharge of granular material and control means for activating said closure means, wherein the improvement comprises:

(a) means for generating an air current;

(b) an air current conveying duct connected at one end to said means for generating an air current and at its other end connected exteriorly to the sidewalls of the hopper adjacent the bottom discharging opening to surround a lateral opening in said sidewalls and extending upwardly and outwardly therefrom so that air is exhausted primarily into the hopper when the hopper is emptied of granular material;

(c) an air exhausting duct extending from said air conveying duct between said means for generating an air current and the hopper so that air is exhausted through said air exhausting duct when the hopper contains granular material;

(d) a vane interposed across said air exhausting duct and pivotally mounted so as to pivot to a first position when air is primarily exhausted into said air exhausting duct and to a second position when air is primarily exhausted through the hopper; and (e) switching means connected in electrical circuit with the control means for activating the closure means and interacting with said vane, such that after the control means for deactivating the closure means has been employed to begin discharge of, then entirely empty the hopper of granular material, the vane is pivoted from its first position to its second position so that the closure means will be activated.

2. In a gravity operated hopper for granular material having a top charging opening, sidewalls converging downwardly to form a bottom discharging opening, closure means for said bottom discharge opening, control means for deactivating said closure means to allow discharge of granular material and control means for activating said closure means, wherein the improvement comprises:

(a) means for generating an air current;

(b) an air current conveying duct connected at one end to said means for generating an air current and at its other end connected exteriorly to the sidewalls of the hopper adjacent the bottom discharging opening to surround a lateral opening in said sidewalls and extending upwardly and outwardly therefrom so that air is exhausted primarily into the hopper when the hopper is emptied of granular material;

(c) an air exhausting duct extending from said air conveying duct between said means for generating an air current and the hopper so that air is exhausted primarily through said air exhausting duct when the hopper contains granular material;

a vane interposed across said air exhausting duct and pivotally mounted so as to pivot to a first position when air is primarily exhausted through said air exhausting duct and to a second position when air is primarily exhausted into the hopper;

(e) means for signaling that the hopper has been emptied of granular material; and (f) switching means connected in electrical circuit with said means for signaling that the hopper has been emptied of granular material and interacting with said vane, such that after the control means for deactivating the closure means has been employed to begin discharge of, then entirely empty the hopper of granular material, the vane is pivoted from its first position to its second position to signal that the hopper has been emptied.

3. In a gravity operated hopper for granular material having a top charging opening, sidewalls converging downwardly to form a bottom discharging opening, closure means for said bottom discharge opening, control means for deactivating said closure means to allow discharge of granular material and control means for activating said closure means wherein the improvement comprises:

(a) means for generating an air current;

(b) an air current conveying duct connected at one end to said means for generating an air current and at its other end connected exteriorly to the sidewalls of the hopper to surround a lateral opening in said sidewalls positioned at a predetermined level and extending upwardly and outwardly therefrom so that air is exhausted primarily into the hopper when the hopper has been partially emptied to said predetermined level;

(c) an air exhausting duct extending from said air conveying duct between said means for generating an air current and the hopper so that air is exhausted primarily through said air exhausting duct when the hopper contains granular material;

(d) a vane interposed across said air exhausting duct and pivotally mounted so as to pivot to a first position when air is primarily exhausted through said air exhausting duct and to a second position when air is primarily exhausted through the hopper; and (e) switching means connected in electrical circuit with the control means for activating the closure means, such that after the control means for deactivating the closure means has been employed to discharge granular material to said predetermined level, the vane is pivoted from its first position to its second position so that the closure means will be activated to prevent futher discharging of granular material.

4. In a gravity operated hopper for granular material hving a top charging opening, sidewalls converging downwardly to form a bottom discharging opening, closure means for said bottom discharge opening, control means for deactivating said closure means to allow discharge of granular material and control means for activating said closure means, wherein the improvement comprises:

(a) means for generating an air current;

(b) an air current conveying duct connected at one end to said means for generating an air current and at its other end connected exteriorly to the sidewalls of the hopper to surround a lateral opening in said sidewalls positioned at a predetermined level and extending upwardly and outwardly therefrom so that air is exhausted primarily into the hopper when the hopper has been partially emptied to said predetermined level;

(c) an air exhausting duct extending from said air conveying duct between said means for generating an air current and the hopper so that air is exhausted primarily through said air exhausting duct when the hopper contains granular material;

(d) a vane interposed across said air exhausting duct and pivotally mounted so as to pivot to a first position when air is primarily exhausted through said air exhausting duct and to a second position when air is primarily exhausted into the hopper;

(e) means for signaling that the hopper has been emptied of granular material; and (f) switching means connected in electrical circuit with said means for signaling that the hopper has been emptied of granular material, such that after the control means for deactivating the closure means has been employed to discharge granular material to said predetermined level, the vane is pivoted from its first position to its second position to signal that the hopper has been partially emptied to said predetermined level.

5. The apparatus as defined in claim 1, 2, 3 or 4 wherein the means for generating an air current is a blower.

6. The apparatus as defined in claim 1, 2, 3 or 4 wherein a couterweight is pivotally mounted on a bearing in fixed angular relation to the vane, such that when the vane is in one position the counterweight will be in engagement with the switching means and when it is in its other position the counterweight will be out of engagement with the switching means.

7. The apparatus as defined in claim 1, 2, 3 or 4 wherein the closure means is a sliding gate connected by linkage means to a hydraulic piston and cylinder combination.

8. The apparatus as defined in claim 1, 2, 3 or 4 wherein the sidewalls of the hopper extend perpendicularly downwardly to form an extension below the bottom discharging opening and wherein a moveable drop sleeve is telescoped on said extension.

9. The apparatus as defined in claim 1, 2, 3 or 4 wherein the hopper is a coal containing hopper mounted on a coke oven larry car.

* * * * *